US006902212B1

(12) United States Patent
Mize

(10) Patent No.: US 6,902,212 B1
(45) Date of Patent: Jun. 7, 2005

(54) HAND HELD BALLOON TIER

(76) Inventor: Karen Jennifer Mize, 1323 Round Pond Rd., LaFayette, GA (US) 30728

( * ) Notice: Subject to any disclaimer, the term of this patent is extended or adjusted under 35 U.S.C. 154(b) by 0 days.

(21) Appl. No.: 10/755,916

(22) Filed: Jan. 13, 2004

(51) Int. Cl.[7] ..... D03J 3/00
(52) U.S. Cl. ..... 289/17
(58) Field of Search ..... 289/1.2, 1.5, 2, 289/3, 4, 13, 14, 17, 18.1

(56) References Cited

U.S. PATENT DOCUMENTS 2,926,036 A * 2/1960 Wimberley ..... 289/17
3,476,423 A * 11/1969 Kentfield ..... 289/17
3,572,788 A * 3/1971 Cruzan ..... 289/17
3,940,169 A * 2/1976 Kock ..... 289/1.5
4,989,906 A * 2/1991 Peverley ..... 289/17
5,039,142 A * 8/1991 Muma ..... 289/17
5,314,217 A * 5/1994 Place ..... 289/17
5,568,950 A * 10/1996 Herren ..... 289/17
5,611,578 A * 3/1997 Angelico et al. ..... 289/17
5,882,051 A * 3/1999 Dreger et al. ..... 289/17
6,082,785 A * 7/2000 Morgan et al. ..... 289/17
6,325,426 B1 * 12/2001 Boesl ..... 289/1.5
6,540,267 B1 * 4/2003 Rohbock et al. ..... 289/1.2

* cited by examiner

*Primary Examiner*—Gary L. Welch
(74) *Attorney, Agent, or Firm*—Stephen J. Stark; Miller & Martin PLLC

(57) ABSTRACT

A balloon knot tying device that has a base with dual rods provided for stretching the leading end of an inflated balloon around to assist in tying a permanent knot. Each rod having at least two diameters to provide a retaining edge so the balloon will not slide down onto the base during the knot tying operation. The base with dual rods can be attached to different holding devices such as a ring shaped device for inserting at least 1 finger or a handle shaped device for gripping. The knot tying operation consisting of holding the balloon against the side of the device and stretching the leading end around the rods to form a loop. The leading end is then crossed under the loop through a relief area and up between the two rods. The leading end is then pulled off of the rods to form a permanent knot.

20 Claims, 10 Drawing Sheets

HAND HELD BALLOON TIER

FIELD OF THE INVENTION

The present invention relates to tying a permanent knot in an elastic party balloon.

BACKGROUND OF THE INVENTION

People purchase elastic party balloons for decorating at parties and the like. After purchasing the balloons, the two main steps in forming them are 1. Inflate the balloon and 2. Tie the balloon. The market currently has pumps available to inflate the balloons with ease. But, a device to tie the balloons is not readily available. Today most people who are not able to blow up a balloon can purchase and own a balloon pump. But, people who have trouble tying balloons can not easily purchase a balloon tying device. Balloons are normally tied by wrapping the balloon around your pointer and middle fingers. Then, trying to tuck the end between the two fingers to close the loop and make a permanent knot. The elastic material the balloons are made of makes this very difficult usually resulting in fatigue, sore, even bleeding fingers. People usually end up frustrated and helpless. There is a need for a hand held device to make tying balloons less painful. The present invention is simple and fills the need of the consumer whether young or old to be able to tie a balloon with ease and without damaging the balloon.

A noteworthy hand held device patent is U.S. Pat. No. 5,568,950 issued October 1996, which is a Hand Held Balloon Tying Device that is a non-reversible u-shaped device with a single one-sided retaining edge. U.S. Pat. No. 6,540,267 issued April 2003 is Balloon Tie-aiding Device with two parallel finger-like supports with no retaining edge that is clamp mounted. U.S. Pat. No. 4,989,906 issued February 1991 is a Device For Tying An Elastic Balloon that is a tank mountable bracket, which holds the balloon neck while the end is stretched and tied. U.S. Pat. No. 5,882,051 issued March 1999 is a Knot-Tieing Device And Method Of Knotting Therewith that is flat with a trapezoidal shaped opening. This device is held between the thumb and index finger, which could be unsteady when tying the balloon on the opposite end. Some devices to aid in balloon tying that have patents are U.S. Pat. No. 6,082,785 issued July 2000, U.S. Pat. No. 5,314,217 issued May 1994, U.S. Pat. No. 5,039,142 issued August 1991, and U.S. Pat. No. 5,611,578 issued March 1997. All of these patents are hand gripping devices that have a slot at the end. These devices do not easily facilitate tying a balloon. All of the above devices are different from the present invention. The present invention overcomes the above mentioned patents' shortcomings by providing for a balloon knot tying device with two rods that have a continuous retaining edge, reversibility, tapered ends, frictional side surface, and a relief area. The invention is also attached to a handle that is gripped or a ring shaped device, which allows a steady hold when tying a balloon. The present invention also aids in tying a balloon at the normal position it would be tied on the fingers. The rods are now taking the stress load that the fingers normally would take during the balloon tying operation. The base can be used with a ring shaped device that the fingers slip through or can be mounted to a grip handle that is held in the hand for people who cannot slide the device comfortable over their fingers to tie a balloon.

SUMMARY OF THE INVENTION

The present invention is made of injection-molded plastic or similar materials with all rounded edges to prevent damage to the balloon. The device has two identical rods. Each rod has a top part and a bottom part. The bottom part is larger around than the top part. The top smaller part is tapered as it moves toward the top. The top part of the rods are what the balloon is wrapped around allowing the balloon to rest on the retaining edge formed by the larger part of the rods. The retaining edge keeps the balloon off the base so the balloon can be routed underneath making room for the fingers to tuck the end through the loop to make the knot. The balloon end is then pulled up and off the rods to finish tying the permanent knot. A relief area is also located on the base to allow room for the finger to tuck the end of the balloon into the loop to tie the knot. The process to tie a balloon using the present invention is: 1. Hold the end of the balloon against the side of the device with the thumb to keep the air from going out. 2. Wrap the balloon end around both top parts of the rods. 3. Push the end of the balloon underneath up into the loop hole. 4. Pull the end of the balloon up and off the rods to close and tighten the knot.

DETAILED DESCRIPTION OF THE INVENTION

Figure 1:
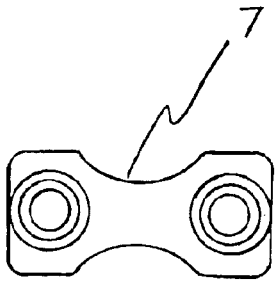
FIG. 1 is a top view of an embodiment of the invention.
Figure 4:
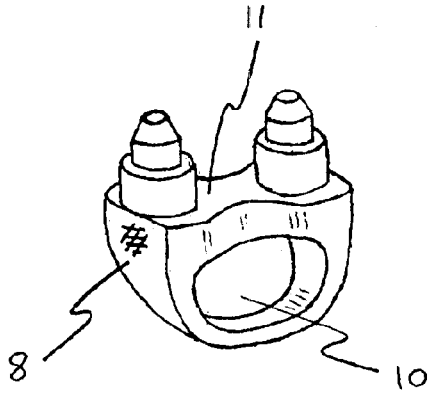
FIG. 4 is an isometric view of an embodiment of the invention.
Figure 2:
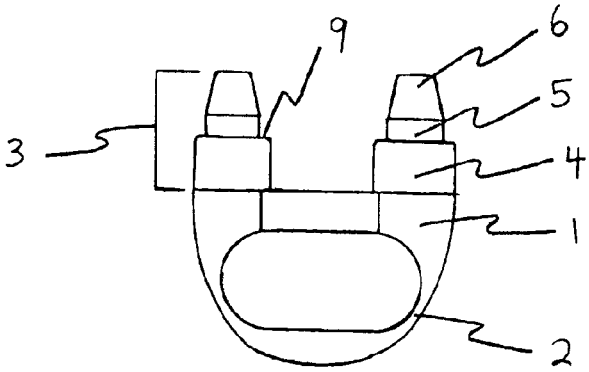
FIG. 2 is a front view of an embodiment of the invention.
Figure 3:
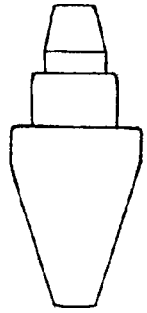
FIG. 3 is a side view of an embodiment of the invention.

Referring to FIGS. 1–4, an embodiment of the invention is shown containing two parallel rods 3, attached to base 1 and perpendicular to surface 11 of base 1. Rods 3 being comprised of a first portion 4 proximal to surface 11 of base 1 and second portion 5 distal to surface 11 of base 1 with tapered end 6. Between first portion 4 and second portion 5 a retaining edge 9 is provided to prevent the balloon from sliding down onto surface 11 and therefore provides an opening to allow room for the finger to insert the balloon end through the balloon loop during the knot tying operation. Base 1 having a ring shaped device 2 which provides an aperture 10 to be used for inserting finger(s) to facilitate holding the device for the balloon knot tying operation. Relief area 7 is provided to further assist balloon knot tying by allowing more room for the finger to sweep through. Textured area 8 is also provided for a friction surface to prevent the balloon from slipping during the knot tying operation. The preferred embodiment of this invention is made of but not limited to injection-molded plastic or similar materials.

Figure 5:
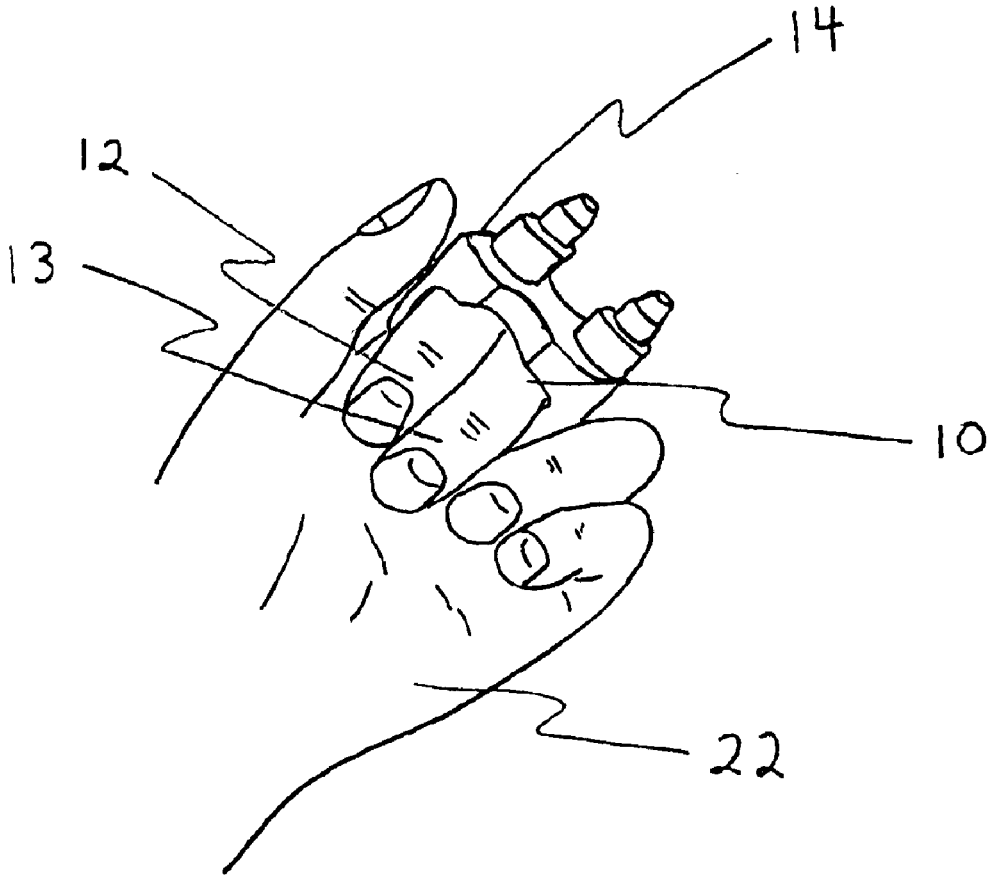
FIGS. 5–12 show steps used during the knot tying operation.
Figure 6:
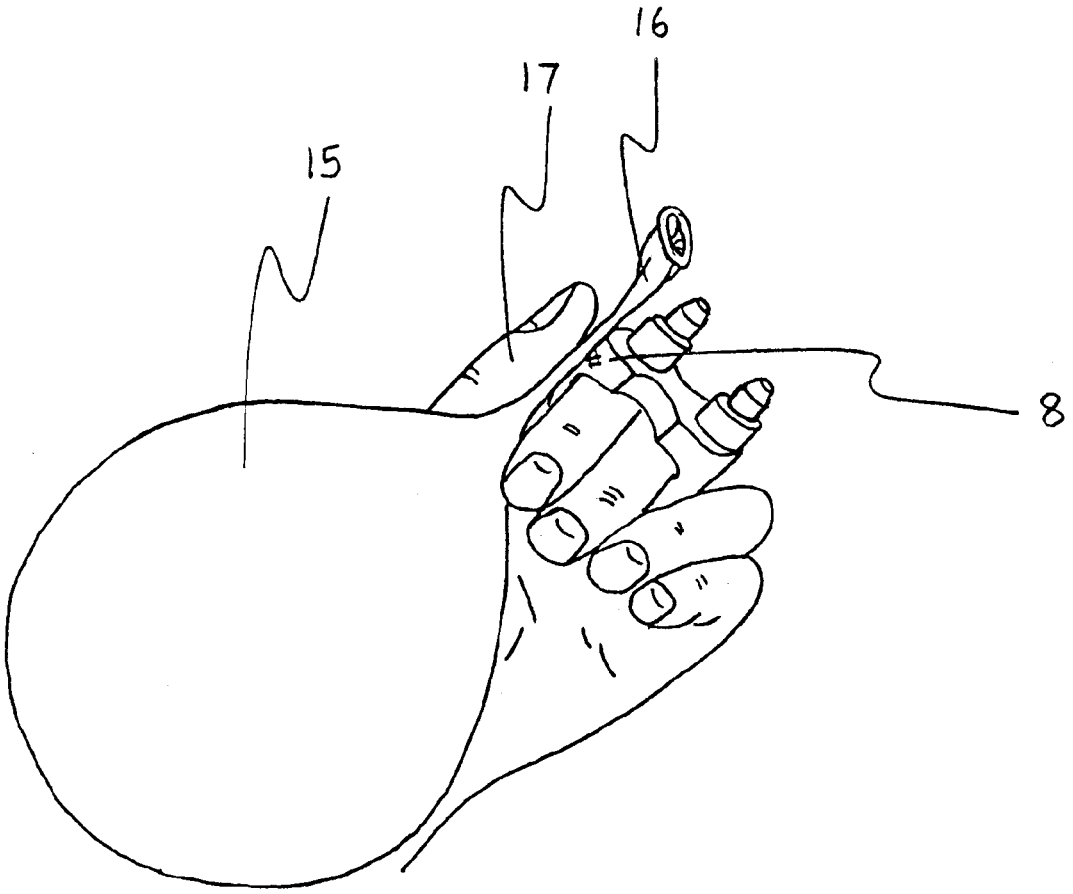
Figure 7:
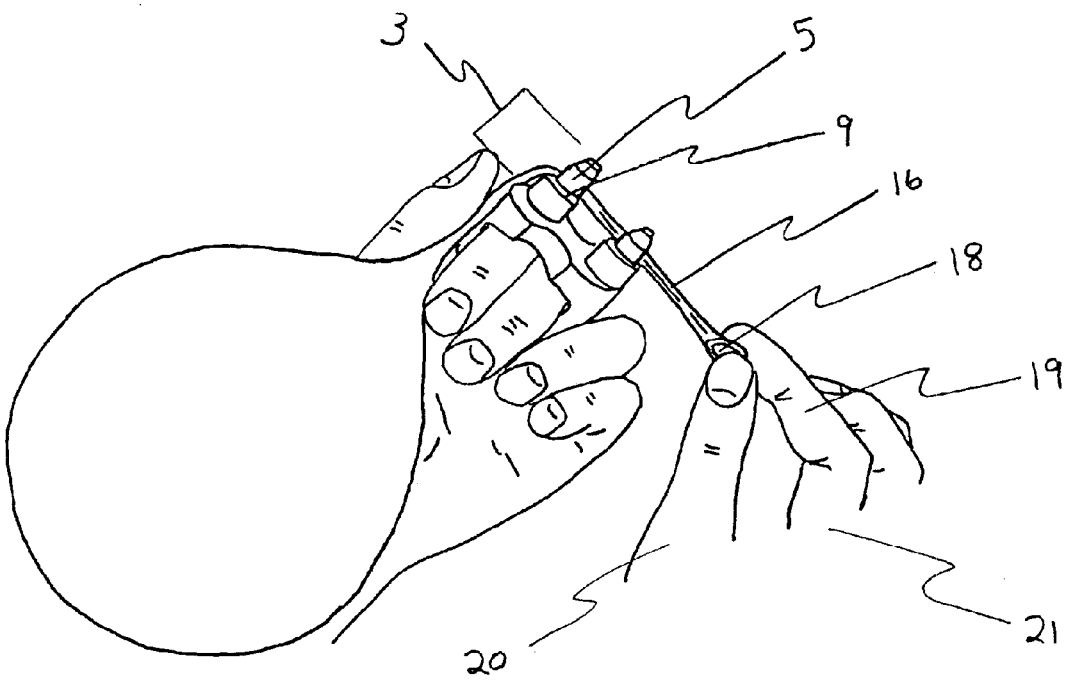
Figure 8:
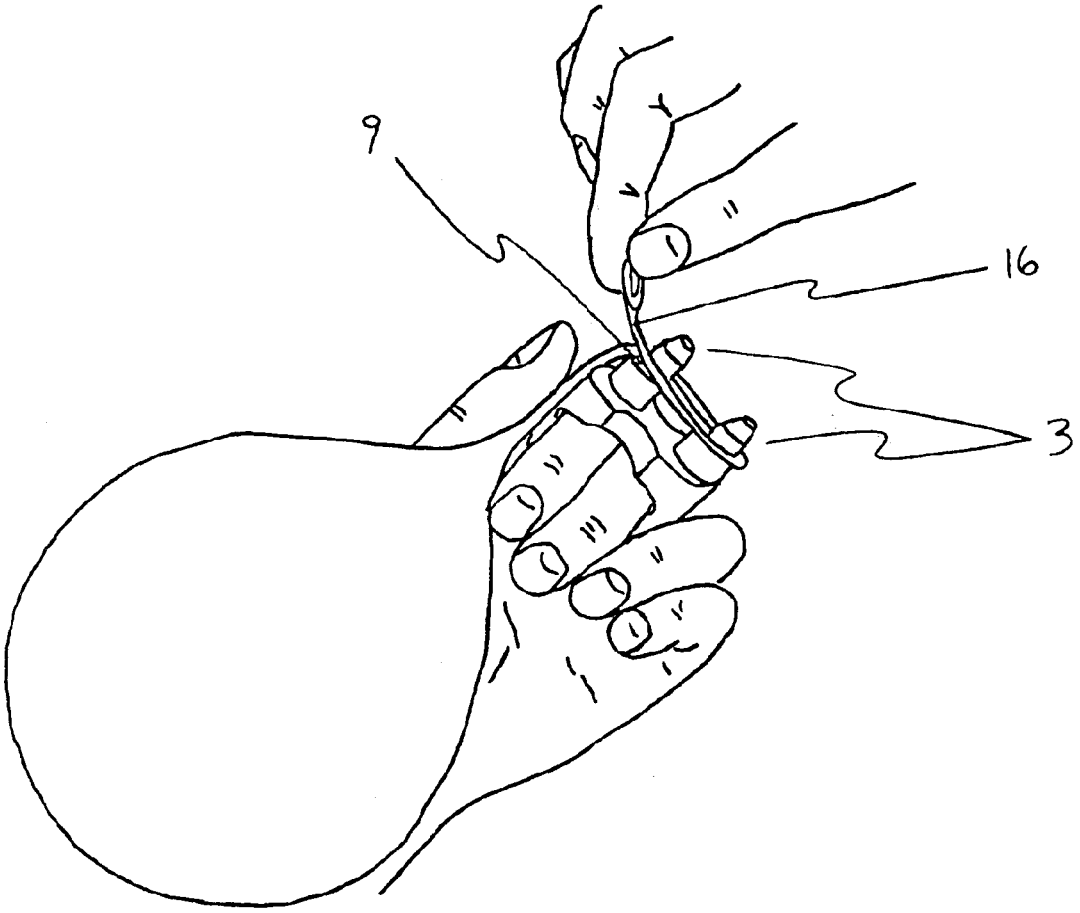
Figure 9:
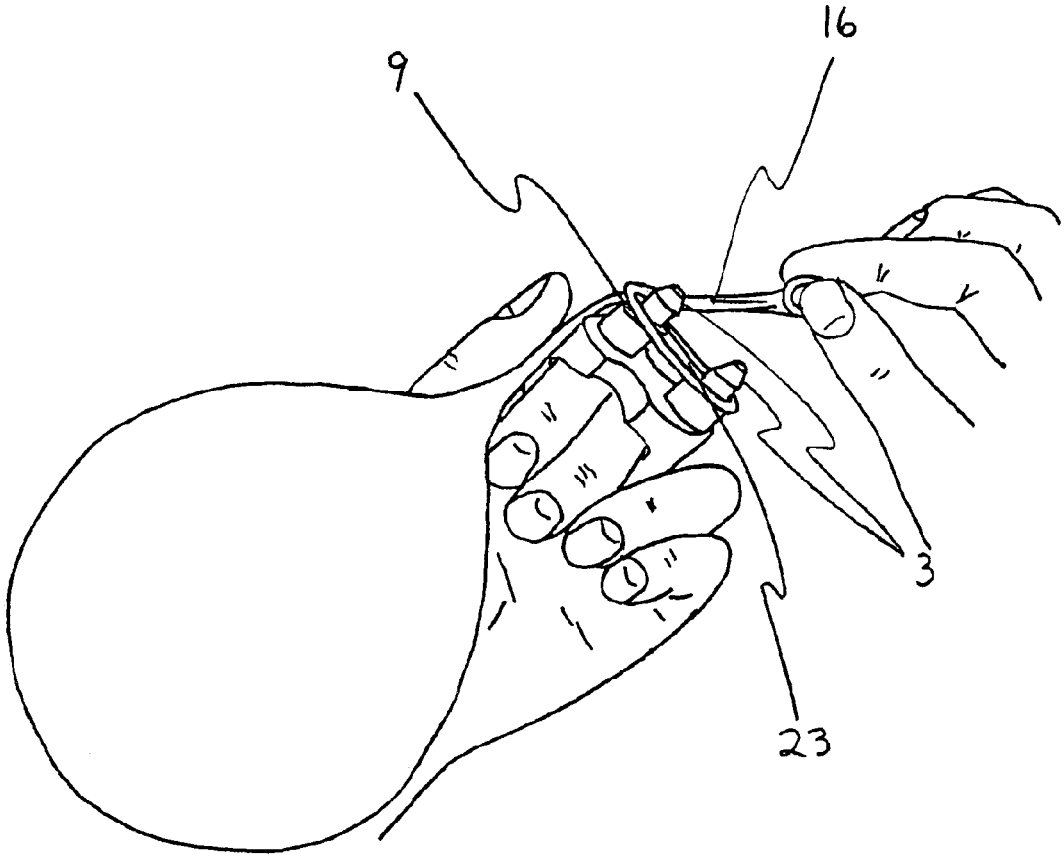
Figure 10:
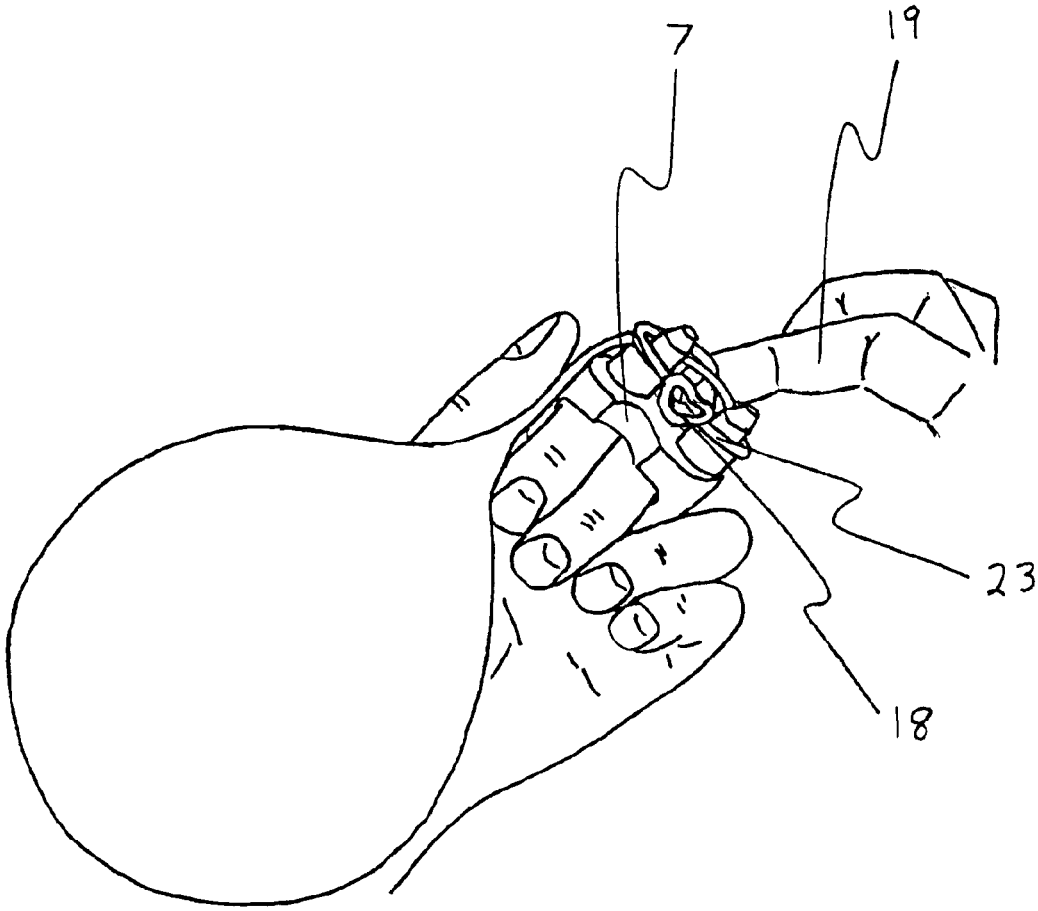
Figure 11:
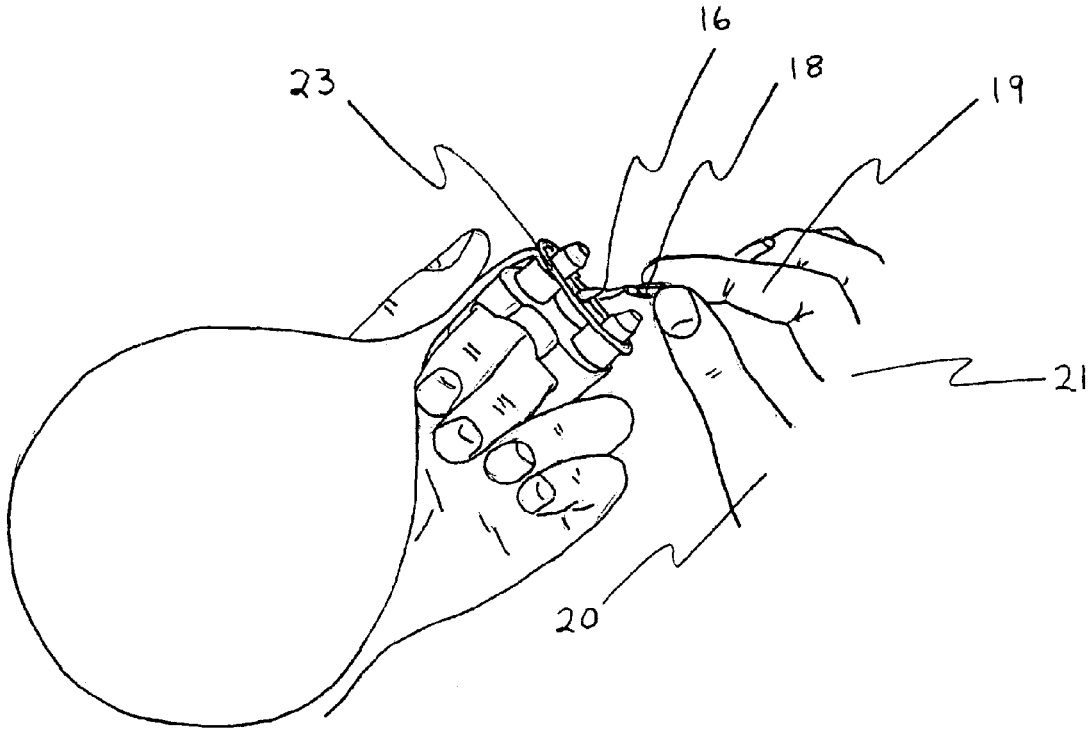
Figure 12:
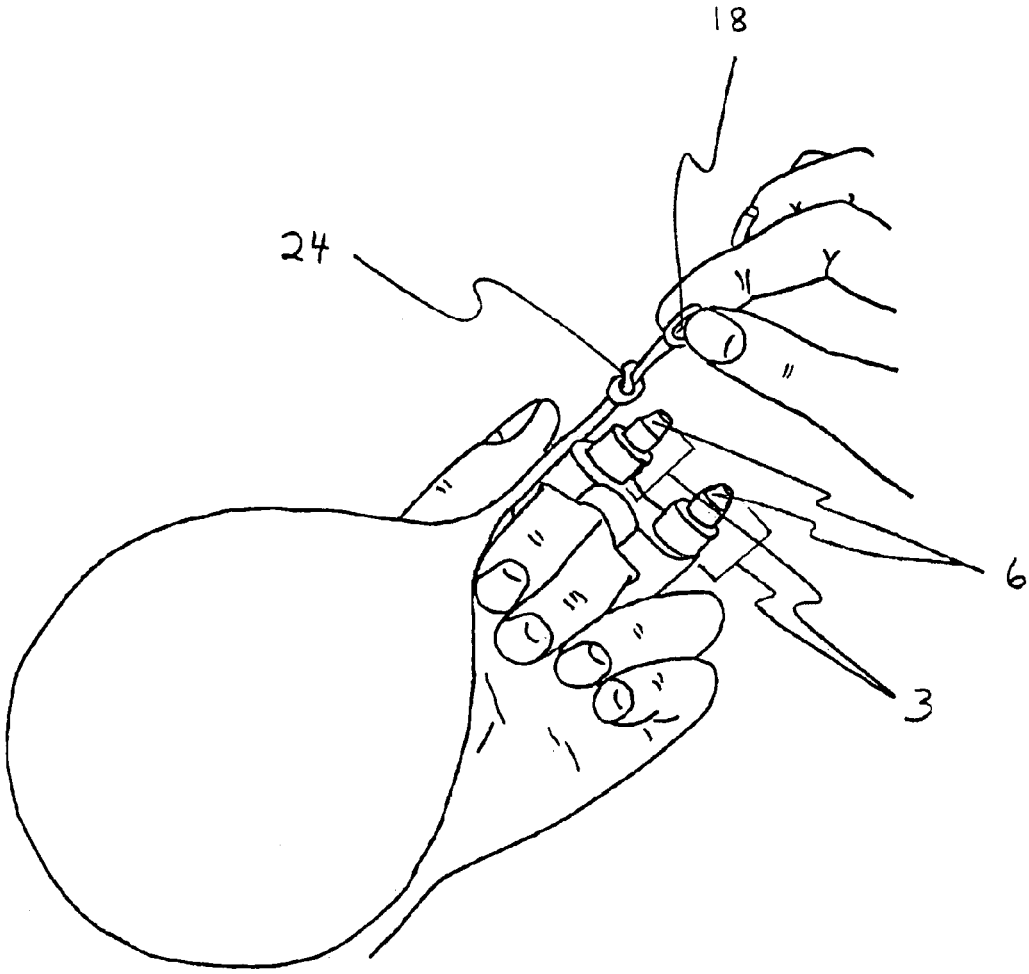
Figure 13:
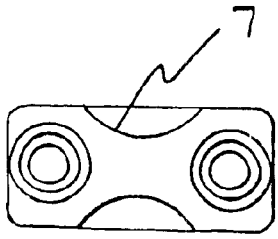
FIGS. 13–16 show an alternate configuration of the invention.
Figure 16:
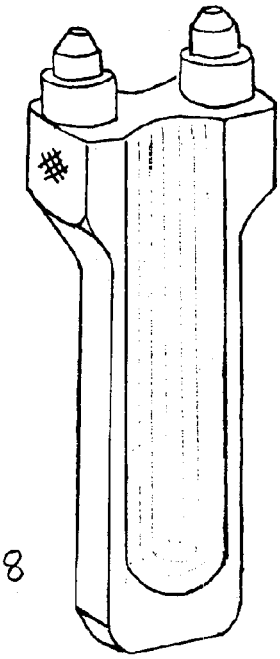
Figure 14:
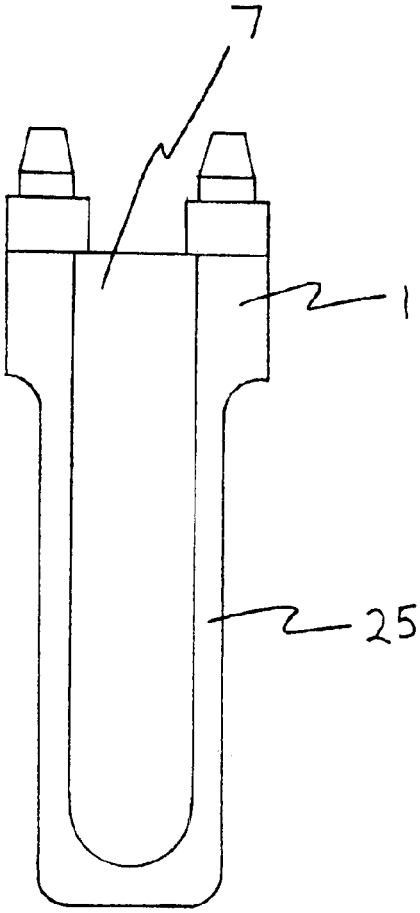
Figure 15:
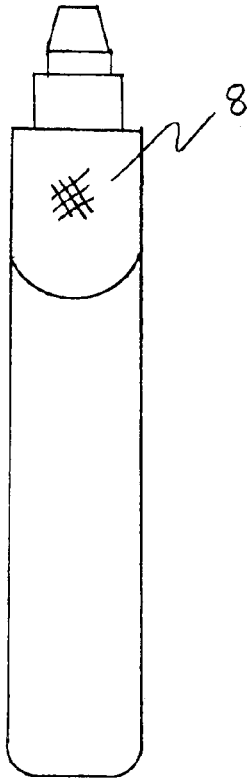

FIGS. 5–12 show the preferred sequential steps for the balloon knot tying operation. Insert fingers 12 and 13 of hand 22 through aperture 10 of the preferred embodiment of the aforementioned invention 14 as shown in FIG. 5. After inflating balloon 15, hold leading end 16 of balloon 15 between thumb 17 and textured area 8 as shown in FIG. 6. Referring next to FIG. 7, pinch balloon opening 18 of leading end 16 between finger 19 and thumb 20 of hand 21. Stretch leading end 16 perpendicular to rods 3 against second portion 5 and retaining edge 9. FIG. 8 shows stretching leading end 16 around rods 3 in a clockwise direction against retaining edge 9. Continuing in a clockwise direction, stretch leading end 16 around rods 3 and against retaining edge 9 back around to the center position as shown in FIG. 9. This forms loop 23. FIG. 10 shows pressing the balloon opening 18 by relief area 7 with finger 19 under and through loop 23. With finger 19 and thumb 20 of hand 21, pinch balloon opening 18 and pull leading edge 16 through loop 23 as shown in FIG. 11. Finally, as shown in FIG. 12 continue to pull balloon opening 18 upward along tapered ends 6 and off of rods 3 completing knot 24.

FIGS. 13–16 show an alternate configuration of the above embodiment of the invention. This configuration has base 1 with a handle 25 instead of a ring shape device. Relief area 7 continues throughout a major portion of handle 25 to also provide for material reduction. Textured area 8 is also provided for a friction surface to prevent the balloon from slipping.

The preferred embodiment of the aforementioned invention has been described in detail. It would be obvious to those skilled in the art that changes and modifications could be made without departing from the scope of the invention as defined by the appended claims.

What is claimed is:

1. A balloon knot tying device comprising:

a base having a first side with first and second cantilever rods connected to the first side of the base; each of said cantilever rods having a first portion with a first diameter and a second portion with a second diameter, said first and second portions meeting at a retaining edge for retaining balloon material during knot tying; said second diameter smaller than said first diameter; said first portion proximal to the base, and the second portion distal to the base; said first and cantilever rods spaced from one another.

2. A balloon knot tying device in accordance with claim 1 wherein said first and second cantilever rods extend parallel to one another and non-collinear with one another and perpendicular to said first side of said base.

3. A balloon knot tying device in accordance with claim 1 wherein the second portion of at least one said first and second cantilever rods further comprises a tapered end.

4. A balloon knot tying device in accordance with claim 1 wherein said first and second cantilever rods extend parallel and non-collinear with one another from the base.

5. A balloon knot tying device in accordance with claim 1 wherein said base is mounted to a handle device.

6. A balloon knot tying device in accordance with claim 5 wherein said base provides a relief area intermediate said first and second cantilever rods to facilitate ease of balloon knot tying; and said first and second rods are symmetrically disposed relative to one another.

7. A balloon knot tying device in accordance with claim 5 further comprising a textured surface area on the sides of the handle to provide a frictional surface area to facilitate ease of balloon knot tying.

8. A balloon knot tying device in accordance with claim 1 further comprising a ring shaped device for attaching to a human hand by sliding over at least one finger.

9. The balloon knot tying device in accordance with claim 8 wherein the ring shaped device further comprises an aperture there through and at least one finger slides through the aperture during use.

10. The balloon knot tying device in accordance with claim 8 further comprising at least one textured surface area on a side of the ring shaped device providing a frictional surface area to facilitate ease of balloon knot tying.

11. A balloon knot tying device in accordance with claim 1 wherein said base provides a relief area intermediate said first and second cantilever rods to facilitate ease of balloon knot tying.

12. A balloon knot tying device comprising:

a base connected to spaced apart first and second cantilevered rods extending from a first side of the base; each of said first and second cantilevered rods having a second portion with a first length and a second diameter along the first length; said second portion extending from a proximal end closer to the base than a distal end; and a tapered end portion extending from a distal end of the second portion; said tapered end portion having a constant slope over at least a section of the tapered end portion.

13. The balloon knot tying device of claim 12 wherein the first and second cantilevered rods each further comprise a first portion having a first diameter at a proximal end of the first portion and the first diameter is greater than the second diameter of the second portion.

14. A balloon knot tying device in accordance with claim 12 wherein said base provides a relief area intermediate said first and second cantilever rods to facilitate ease of balloon knot tying.

15. A balloon knot tying device in accordance with claim 12 wherein said base is mounted to a handle device.

16. A balloon knot tying device in accordance with claim 15 wherein said base provides a relief area intermediate said first and second cantilever rods to facilitate ease of balloon knot tying.

17. A balloon knot tying device in accordance with claim 15 further comprising a textured surface area on the sides of the handle to provide a frictional surface area to facilitate ease of balloon knot tying.

18. A balloon knot tying device in accordance with claim 12 further comprising a ring shaped device for attaching to a human hand by sliding over at least one finger.

19. The balloon knot tying device in accordance with claim 18 wherein the ring shaped device further comprises an aperture there through and at least one finger slides through the aperture during use.

20. The balloon knot tying device in accordance with claim 18 further comprising at least one textured surface area on a side of the ring shaped device providing a frictional surface area to facilitate ease of balloon knot tying.

* * * * *